US005154498A

United States Patent [19]

Slater

[11] Patent Number: 5,154,498

[45] Date of Patent: Oct. 13, 1992

[54] DESK SECRETARY APPARATUS

[76] Inventor: Fred N. Slater, 21747 Webster St., Perris, Calif. 92370

[21] Appl. No.: 742,328

[22] Filed: Aug. 8, 1991

[51] Int. Cl.[5] ..... A47B 97/04

[52] U.S. Cl. ..... 312/230; 312/231; 312/236

[58] Field of Search ..... 312/230, 231, 326, 327, 312/328, 236; 248/444

[56] References Cited

U.S. PATENT DOCUMENTS

| | | | |
|---|---|---|---|
| 193,140 | 7/1877 | Brownell | 312/231 |
| 2,638,397 | 5/1953 | Wykoff | 312/231 |
| 4,892,334 | 1/1990 | Sinclair | 248/444 X |

*Primary Examiner*—Joseph Falk

*Attorney, Agent, or Firm*—Leon Gilden

[57] ABSTRACT

A desk secretary arranged for the storage of information components in a perimeter relationship about the central memo board, wherein the memo board is of an erasable polymeric sheet construction. An upper board member mounted to the lower board member at an oblique angle thereto provides support for various information components such as a calendar and the like. A magnetized memo plate is positioned along a left border plate of the lower board member for mounting various removable magnetic plate members thereto for support of messages. A modification of the invention includes a cooling housing selectively and removably mounted relative to the upper board member to direct a cooling air to a user of the organization permitting its use in a convenient manner in various environments.

5 Claims, 4 Drawing Sheets

DESK SECRETARY APPARATUS

BACKGROUND OF THE INVENTION

1. Field of the Invention

The field of invention relates to portable desk apparatus, and more particularly pertains to a new and improved desk secretary apparatus wherein the same is arranged for the convenient mounting of various informational components relative to the apparatus for their use.

2. Description of the Prior Art

Portable desk apparatus of various types are utilized in the prior art for the mounting of messages and the like and for storage of various components of information. Such apparatus is exemplified in U.S. Pat. No. 3,798,813 to Dahl, Jr. wherein a magnetic tray for filing system designed as a housing with various files positioned therewithin.

U.S. Pat. No. 4,919,276 to Kim; et al. sets forth a portable desk top tray utilizing a central container formed with a forwardly positioned support for envelopes, a cavity for stamp dispensing, and a further cavity for writing instruments.

U.S. Pat. No. 4,848,584 to Windorski sets forth a note paper dispensing tray for positioning a stack of note paper therewithin.

As such, it may be appreciated that there continues to be a need for a new and improved desk secretary apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of portable desk apparatus now present in the prior art, the present invention provides a desk secretary apparatus wherein the same is arranged for the positioning and securement of magnetized memo plates along a border of the lower board member, with a further perimeter of the board member including support for a calculator, clock, and an upper border defining a "U" shaped perimeter about a central writing surface including depressions for positioning drinking cups and the like therewithin. As such, the general purpose of the present invention, which will be described subsequently in greater detail, is to provide a new and improved desk secretary apparatus which has all the advantages of the prior art portable desk apparatus and none of the disadvantages.

To attain this, the present invention provides a desk secretary arranged for the storage of information components in a perimeter relationship about the central memo board, wherein the memo board is of an erasable polymeric sheet construction. An upper board member mounted to the lower board member at an oblique angle thereto provides support for various information components such as a calendar and the like. A magnetized memo plate is positioned along a left border plate of the lower board member for mounting various removable magnetic plate members thereto for support of messages. A modification of the invention includes a cooling housing selectively and removably mounted relative to the upper board member to direct a cooling air to a user of the organization permitting its use in a convenient manner in various environments.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved desk secretary apparatus which has all the advantages of the prior art portable desk apparatus and none of the disadvantages.

It is another object of the present invention to provide a new and improved desk secretary apparatus which may be easily and efficiently manufactured and marketed.

It is a further object of the present invention to provide a new and improved desk secretary apparatus which is of a durable and reliable construction.

An even further object of the present invention is to provide a new and improved desk secretary apparatus which is susceptible of a low cost of manufacture with regard to both materials and labor, and which accordingly is then susceptible of low prices of sale to the consuming public, thereby making such desk secretary apparatus economically available to the buying public.

Still yet another object of the present invention is to provide a new and improved desk secretary apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
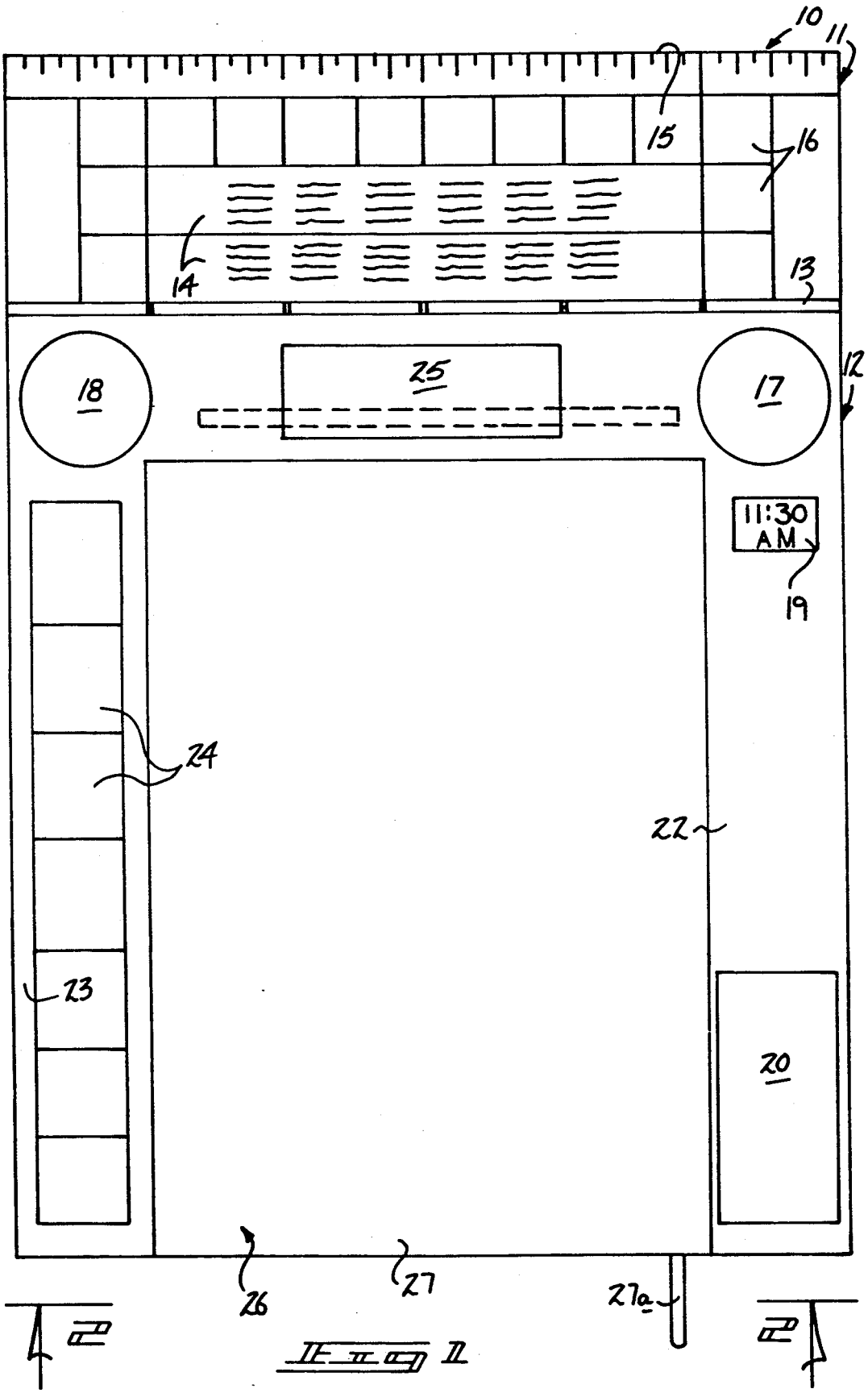
FIG. 1 is an orthographic top view of the instant invention.
Figures 2, 3:
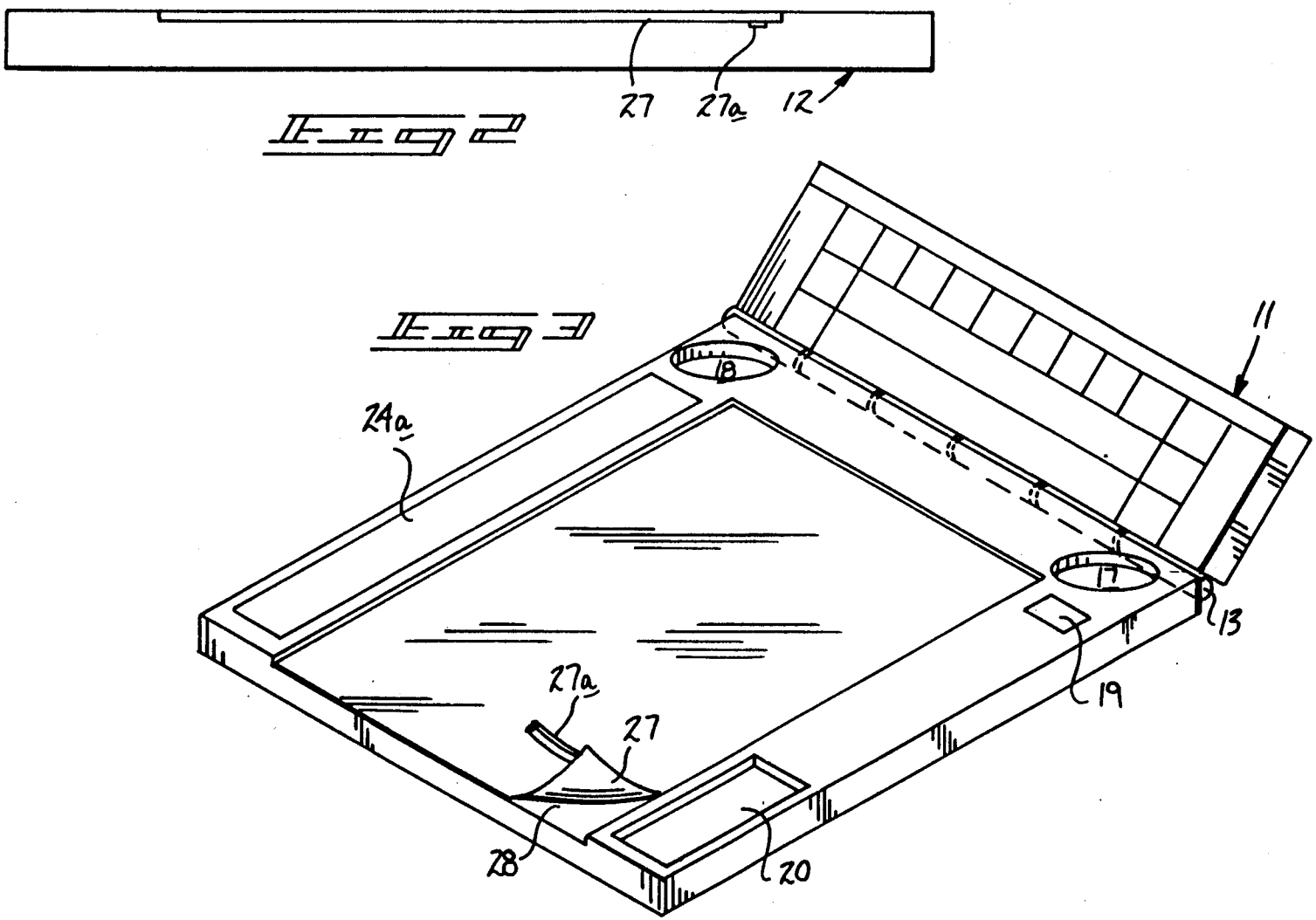
FIG. 2 is an orthographic end view of the apparatus, taken along the lines 2—2 of FIG. 1 in the direction indicated by the arrows.
FIG. 3 is an isometric illustration of the instant invention.

With reference now to the drawings, and in particular to FIGS. 1 to 10 thereof, a new and improved desk secretary apparatus embodying the principles and concepts of the present invention and generally designated by the reference numerals 10 and 10*a* will be described.

More specifically, the desk secretary apparatus 10 of the instant invention essentially comprises an upper board member 11 hingedly mounted to a lower board member 12 about a spring hinge 13 to orient the upper board member to the lower board member in a generally oblique angle. The upper board member includes a plurality of calendar slots 14 to receive calendar cards therewithin for apprising of correct dating for use by an individual. A measuring rule 15 is mounted at an upper edge of the upper board member 11, with the upper board member further including card mounting squares 16 to receive various informative cards, such as advertisements, notes, and the like.

The lower board member includes a top perimeter "U" shaped surface defined by a right lower board member margin plate and a left lower board member margin plate 22 and 23 respectively, including a top plate in planar association with the right and left margin plates, with a central desk plate positioned within the "U" shaped margin of the lower board member. A first and second respective cup receiving cavity 17 and 18 are positioned at an intersection of the respective right and left margin plates, with the top margin plate further including a marker well 25 for receiving various marking and writing implements therewithin. A clock member 19 is mounted within the right margin plate, as well as a calculator cavity 20 to receive a calculator 21 therewithin. Any suitable calculator may be utilized, such as a solar powered calculator and the like, commercially available. The left margin plate 23 includes a row of magnetized cards 24 selectively securable to a ferromagnetic plate 24*a* underlying the cards for mounting various messages on the left margin plate for ease of observation and reuse by an individual in utilization of the organization.

The central desk plate 26 includes a lift-up polymeric sheet 27 hingedly mounted at its upper terminal end adjacent the top margin plate, with a lift-up tab 27*a* mounted to the lower terminal edge of the polymeric sheet to permit ease of lifting of the sheet to effect selective erasure of various notes thereon. An underlying plate 28 accommodates a message directed through the sheet 27. Alternatively, the lever 27*a* may be movably mounted (not shown) between the sheet 27 and plate 28 to effect erasure of scribings upon the sheet 27 if desired.

Figure 4:
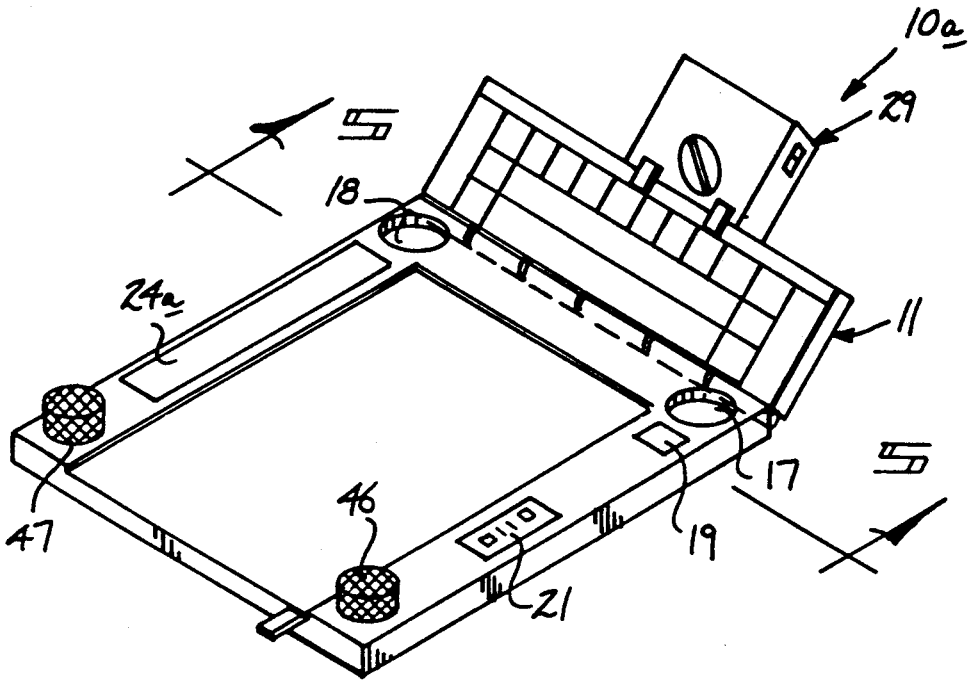
FIG. 4 is an isometric illustration of a modification of the invention.
Figure 5:
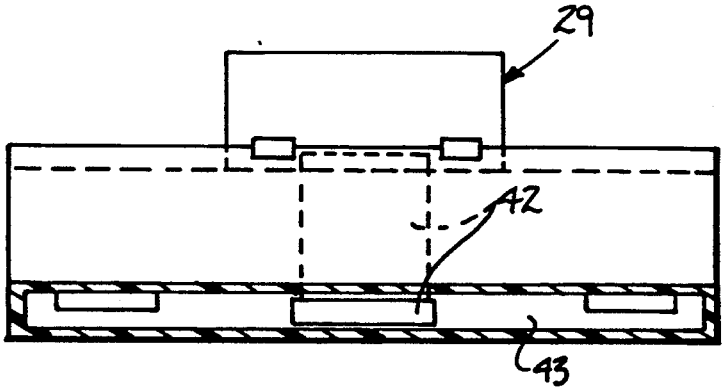
FIG. 5 is an orthographic view, taken along the lines 5—5 of FIG. 4 in the direction indicated by the arrows.
Figure 6:
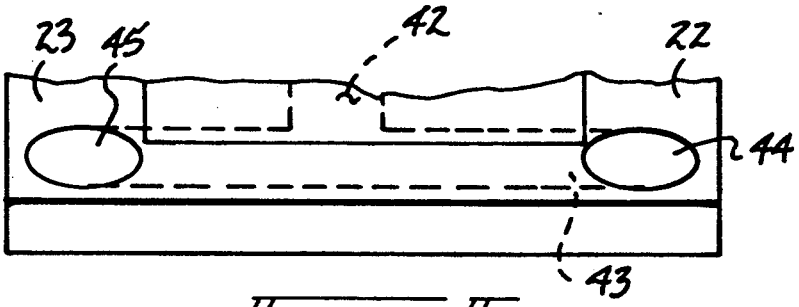
FIG. 6 is an isometric illustration of the lower board member and the conduit structure directed therethrough.
Figure 7:
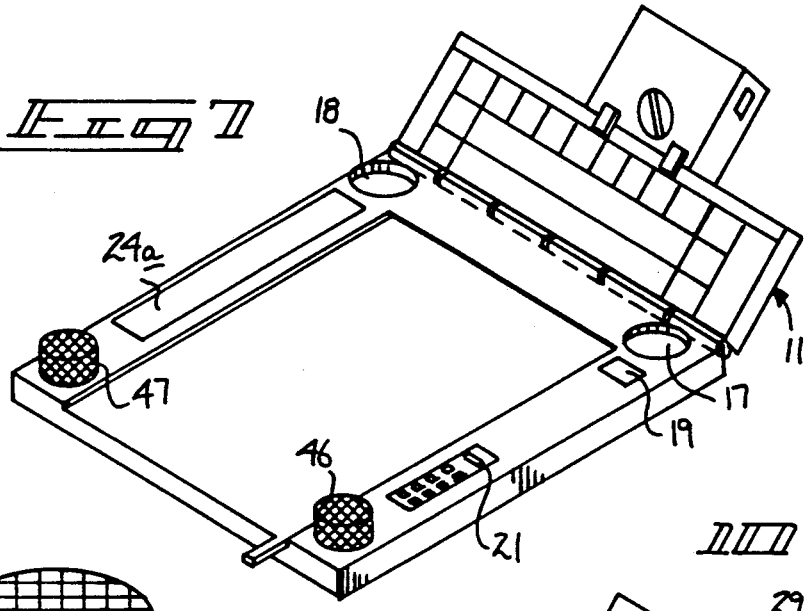
FIG. 7 is an isometric illustration of the invention in an assembled illustration.
Figure 8:
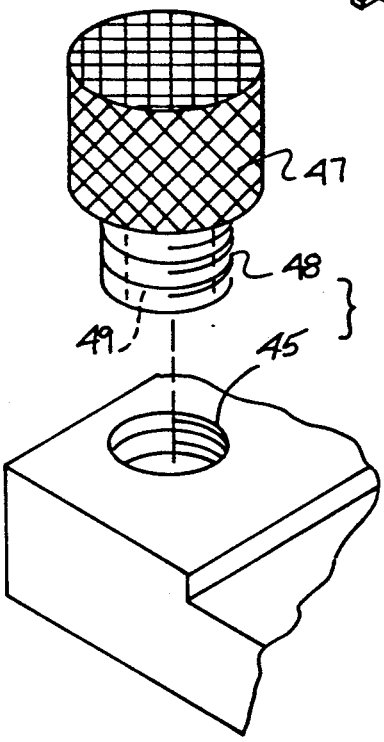
FIG. 8 is an isometric illustration, somewhat enlarged, of the defuser structure utilized by the instant invention.
Figure 9:
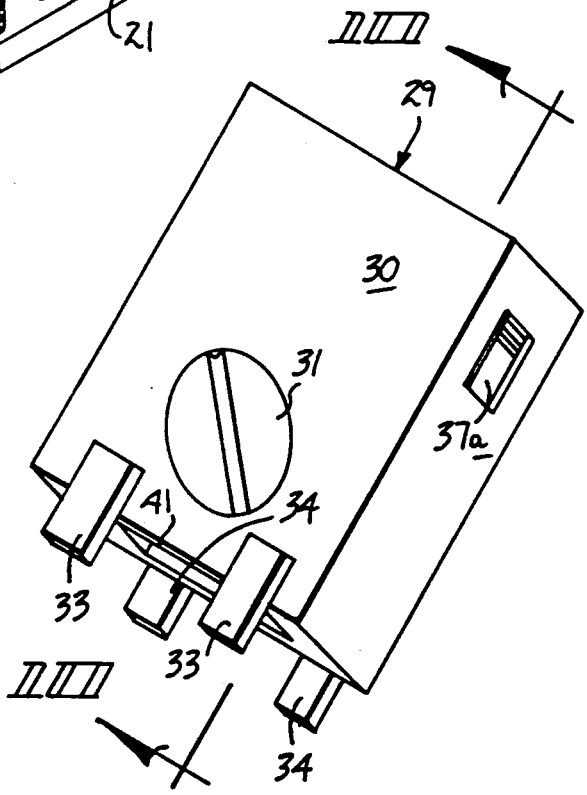
FIG. 9 is an isometric illustration of the cooling housing utilized by the invention.
Figure 10:
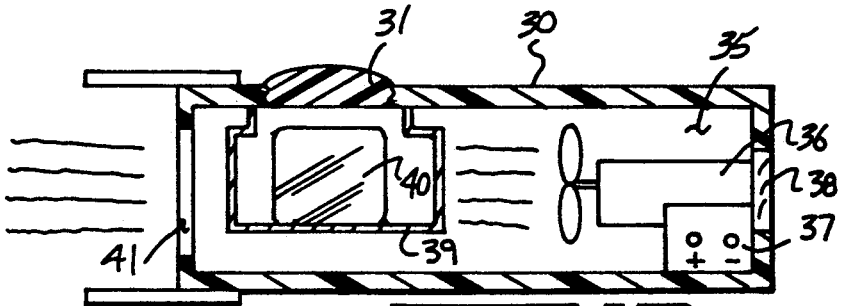
FIG. 10 is an orthographic view, taken along the lines 10—10 of FIG. 9 in the direction indicated by the arrows.

A modification 10*a* of the invention is depicted in FIG. 4 for example and includes a cooling housing 29 selectively mounted to the upper board member 11, with the cooling housing 29 including a housing top wall 30 spaced from a housing bottom wall 32, with a removable plug 31 mounted to the housing top wall 30 for access to an underlying wire mesh cooling cage 39 to include an ice member 40 therewithin. The ice member is formed of typically frozen carbon dioxide or otherwise known as "dry ice", wherein the housing includes a housing chamber 35 mounting a blower motor 36 between a rear wall of the housing and the wire mesh cooling cage. A battery 37 is operative to effect selective actuation of the blower motor 36 through a switch 37*a*. An inlet screen 38 directed through the rear wall of the housing permits the blower motor 36 to direct cooling air through the cooling cage 39. The housing includes a plurality of upper mounting legs 33 spaced from a plurality of lower mounting legs 34 spaced apart a predetermined spacing substantially equal to a thickness of the upper board member 11 to provide mounting of the cooling housing 29 to the upper board member 11, as illustrated in FIG. 4 for example. A housing outlet conduit 42 directed through the forward wall of the housing is in pneumatic communication with an upper board member first conduit 42 directed through the upper board member, as illustrated in FIG. 5 for example, and in communication with a lower board member second conduit 43 intersecting the second conduit 43 to direct a cooling air flow thereto and to thereafter project a cooling air flow through respective conduit first and second threaded outlet bores 44 and 45 positioned within lower end portions of the respective right and left margin plates 22 and 23. A respective first and second mesh defuser boss 46 and 47 respectively is mounted within respective first and second bores 44 and 45. Each boss includes an externally threaded plug 48 with a through-extending conduit 49 directed therewithin to direct the cooling medium through the plug conduit 49 through the wire mesh head portion to provide a cooling medium of air projected thereabout to provide enhanced comfort in use of the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A desk secretary apparatus, comprising, an upper board member pivotally mounted to a lower board member, with a spring hinge mounting the upper board member to the lower board member to define an oblique angle therebetween, the upper board member including a plurality of slots to receive information cards therewithin, and the lower board member including a "U" shaped perimeter surface, with the "U" shaped perimeter surface including a right margin plate spaced from and parallel a left margin plate, and a top margin plate interconnecting the right and left margin plates, with the top margin plate positioned adjacent the upper board member, the right margin plate including a first well to receive a calculator member therewithin, and a second well to receive a clock member therewithin, and the top margin plate including a plurality of cylindrical cup receiving cavities therewithin to receive drinking cups, and the left margin plate including a ferromagnetic plate, and a plurality of magnetized cards selectively mounted to the ferromagnetic plate, wherein the magnetized cards are arranged to accommodate message indicia thereon, and a central desk positioned within the right margin plate, the left margin plate, and the top margin plate, the central desk including a flexible polymeric sheet hingedly mounted adjacent the top margin plate, and an underlying marker plate, the polymeric sheet including a tab projecting exteriorly of the polymeric sheet to provide manual grasping of the polymeric sheet.

2. An apparatus as set forth in claim 1 wherein the upper board member and the lower board member include a first pneumatic conduit directed communication with a second pneumatic conduit in pneumatic communication with a second pneumatic conduit, the second pneumatic conduit positioned within the lower board member adjacent a lower end portion of the lower board member, and the second pneumatic conduit including a respective first and second outlet bore positioned through the respective right and left margin plates, and a cooling housing mounted to the upper board member, with the cooling housing in pneumatic communication with the first conduit.

3. An apparatus as set forth in claim 2 wherein each outlet bore includes a defuser boss, the defuser boss including a wire mesh head portion positioned above the upper board member, and each defuser boss including a plug member, each plug member of each defuser boss receivable within the first and second outlet bore, and each plug member including a plug conduit directed through the plug member for directing pneumatic airflow through each defuser boss.

4. An apparatus as set forth in claim 3 wherein the cooling housing includes a housing top wall spaced from a housing bottom wall, and a housing rear wall spaced from a housing forward wall, and the housing forward wall including an outlet conduit in pneumatic communication with the first conduit, and the housing including a housing chamber, the housing chamber including a blower motor positioned adjacent the rear wall, the rear wall including an inlet screen directed through the rear wall in alignment with the blower motor to direct airflow into the cooling housing, and the blower motor including switch means for selective actuation of the blower motor, and the housing top wall including a removable plug, the removable plug positioned above a wire mesh cooling cage, the wire mesh cooling cage receiving a cooling medium therewithin in alignment with a blower motor.

5. An apparatus as set forth in claim 4 wherein the housing top wall includes a plurality of upper mounting legs, and the housing bottom wall includes a plurality of lower mounting legs, the upper mounting legs and the lower mounting legs spaced apart a predetermined spacing, wherein the upper board member is defined by a predetermined thickness substantially equal to the predetermined spacing to align the cooling housing to the upper board member.

* * * * *